US006787704B2

(12) United States Patent
Owen

(10) Patent No.: US 6,787,704 B2
(45) Date of Patent: Sep. 7, 2004

(54) METHOD AND APPARATUS FOR INCREASING THE RATING OF A TRANSFORMER

(76) Inventor: Donald W. Owen, 7719 E. 53rd Pl., Tulsa, OK (US) 74145

( * ) Notice: Subject to any disclaimer, the term of this patent is extended or adjusted under 35 U.S.C. 154(b) by 89 days.

(21) Appl. No.: 09/850,657

(22) Filed: May 7, 2001

(65) Prior Publication Data

US 2002/0021200 A1 Feb. 21, 2002

Related U.S. Application Data

(60) Provisional application No. 60/202,625, filed on May 9, 2000.

(51) Int. Cl.[7] ..... H01B 17/58

(52) U.S. Cl. ..... 174/167; 174/152 R; 174/142; 174/152 G; 174/153 G; 174/151

(58) Field of Search ..... 174/167, 152 R, 174/142, 152 G, 153 G, 151

(56) References Cited

U.S. PATENT DOCUMENTS 2,091,798 A * 8/1937 Sevison ..... 439/271

4,133,090 A * 1/1979 Peterson ..... 445/46

* cited by examiner

*Primary Examiner*—Dean A. Reichard
*Assistant Examiner*—Jinhee Lee
(74) *Attorney, Agent, or Firm*—Dillon & Yudell LLP

(57) ABSTRACT

The voltage class rating of a transformer is increased by increasing the rating of an off the shelf molded transformer bushing. Specifically, the voltage class rating is increased by increasing the distance from the non-insulated portion of a conductor of a transformer bushing and the transformer wall. A conductive extension is connected to the conductor of the bushing. Insulating material in the form of mastic and heat shrink tubing is applied to the external portion of the conductor and the extension. When the modified transformer bushing is installed into a transformer, an internal end of the conductor is made to extend below the surface of the oil in the transformer. The level of the oil also covers an internal insulating shoulder of the bushing. The insulating values of the mastic and heat shrink tubing and the insulating value of the conductor immersed in oil combine to increase the voltage class rating of the off the shelf molded transformer bushing and thereby the transformer, with a nominal increase in costs.

5 Claims, 6 Drawing Sheets

| Length (Inches) | Voltage Rating (VAC RMS) |
|---|---|
| 3.0 | 5000 |
| 3.5 | 5833 |
| 4.0 | 6667 |
| 4.5 | 7500 |
| 5.0 | 8333 |
| 5.5 | 9167 |
| 6.0 | 10000 |
| | |

*FIG. 5*

METHOD AND APPARATUS FOR INCREASING THE RATING OF A TRANSFORMER

CROSS-REFERENCE TO RELATED APPLICATIONS

The present invention claims the benefit of the filing date of the provisional application, U.S. Serial No. 60/202,625, filed on May 9, 2000.

BACKGROUND OF THE INVENTION

1. Technical Field

The present invention generally relates to transformers and in particular to bushings utilized within transformers. Still more particularly, the present invention relates to a method and apparatus for increasing the rating of a transformer via enhancements to the bushing utilized within the transformer.

2. Description of the Related Art

In the oil-filled transformer industry, transformer capacity is determined based on how much voltage the transformer can safely handle. The amount of voltage a transformer can handle depends on several factors, including the electrical connections of the bushing utilized within the transformer, i.e., the bushing terminals. Bushing terminals are used to hold the electrical conductors and transfer current from outside of the transformer to windings or coils on the inside of the transformer without shorting out on the transformer wall.

Bushing terminals (or bushings) commonly comprise an insulating bracket, a conductor, and provision for mounting the bracket to the transformer to insulate the conductor from the transformer wall. Bushings are rated on how well they insulate the transformer wall from current flowing through the conductor. One factor that must be considered in the rating of bushing terminals is the presence of contaminants on the bushing. Contaminants on the bushing provide a conductive path, which can cause electricity to leak out onto the transformer wall and cause electrical arcing or striking. Arcing occurs when the difference in potential between the transformer wall and the conductor becomes sufficiently large. The air ionizes between the transformer wall and the conductor, and this creates a path of relatively low resistance through which current can flow. The resulting blast of electricity can cause a short circuit to occur and severely damage the transformer.

Another factor used to rate bushings is electrical "creepage" across the insulating bracket. Creepage is the electrical leakage on a solid dielectric surface. Creepage distance is the shortest distance on a dielectric surface between two conductive elements. The current will essentially track or crawl across the insulating bracket onto the transformer wall. The onset of creepage can produce similar effects to contamination in that a short circuit to the transformer wall can occur and cause damage to the transformer itself.

One solution utilized to minimize these problems is the use of a material with a high insulating property such as porcelain to create the bushing. One such porcelain bushing is manufactured by Normandy Machine Co. Inc. of Troy, Mo. and is rated to 5 kV (5000 volts). However, porcelain is not durable and is easily broken. A broken or damaged bushing requires costly replacement and down time of the transformer. To make the insulating material more durable, plastic is often used. One such plastic bushing is manufactured by Central Moloney Inc of Pine Bluff, Ark. under the trademark of Tuf Ex-Mount™.

FIG. 4A is a line drawing of a Central Moloney Inc. Tuf Ex-Mount™ molded transformer bushing as cited above. Bushing 400 contains insulating mounting bracket 408 having a first shoulder 410 and second shoulder 406. Extending from second shoulder 406 of insulating mounting bracket 408 is a threaded portion 402 of a conductor 404. Conductor 404 extends from first shoulder 410 of insulating mounting bracket 408 and includes a front end 412 utilized for connecting to transformer windings. FIG. 4B represents bushing 400 installed in an oil-filled transformer. Typically, bushing 400 is not immersed in oil 414 causing a reduction in voltage capacity.

When mounted, the inside and outside surfaces of Tuf Ex-Mount™ are rated at 1.2 kV. In addition, the creepage and strike distances are also designed for use at 1.2 kV. Notably, the molded 1.2 kV bushing is designed and used such that the external hardware may be installed or exchanged in the field. The low voltage rating of the plastic bushing when compared to the porcelain bushing is primarily due to its smaller dimensions. Utilization of 1.2 kV Tuf Ex-Mount bushing at a higher voltage than 1.2 kV will result in higher incidents of arcing, striking, or creepage across the insulating bracket.

Therefore, the present invention recognizes that a need exists for a durable, cost effective method for reducing the external creepage and incidents of arcing when using transformer bushings.

SUMMARY OF THE INVENTION

It is therefore one object of the present invention to increase the voltage class of a transformer.

It is another object of the present invention to decrease the external creepage on bushings.

It is yet another object of the present invention to provide an increased strike distance from the conductor of the bushing to a transformer wall.

The foregoing objects are achieved as is now described. The voltage class rating of a transformer is increased by increasing the rating of an off the shelf molded transformer bushing. Specifically, the voltage class rating is increased by increasing the distance between the non-insulated portion of a conductor of a transformer bushing and the transformer wall. Insulating material is connected to the external insulating shoulder of the bushing and covers some of the external portion of the conductor. In the preferred embodiment, the insulating material comprises heat shrink tubing, and, in one variation of the preferred embodiment, mastic is applied beneath the insulating material.

When the modified transformer bushing is installed into a transformer, an internal end of the conductor is made to extend below the surface of the oil in the transformer. The level of the oil also covers an internal insulating shoulder of the bushing. The insulating values of the mastic and heat shrink tubing and the insulating value of the conductor immersed in oil combine to increase the voltage class rating of the off the shelf molded transformer bushing and thereby the rating of the transformer with a nominal increase in costs.

In one embodiment, a conductive extension is connected to the conductor of the bushing. The insulator is then extended beyond the conductor to also cover a portion of the extension. This provides an even longer distance between the exposed conductive end and the transformer wall, further reducing the occurrence and effects of arcing and electrical creepage.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 5 is a table exemplifying the relationship between transformer rating and length of bushing according to one embodiment of the invention.

DESCRIPTION OF THE PREFERRED EMBODIMENT

Figure 1:
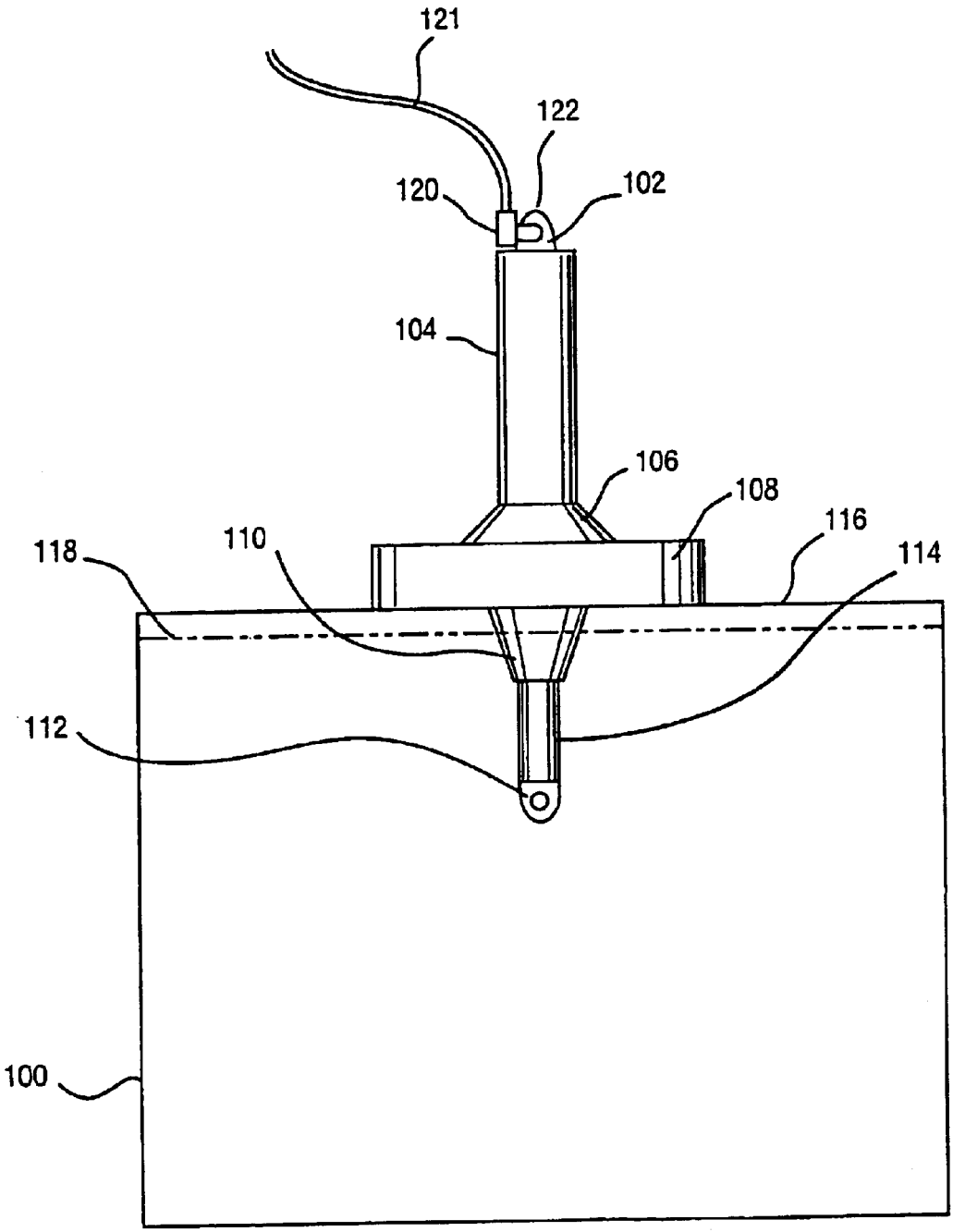
FIG. 1 is a block diagram of a transformer with a converted transformer bushing in accordance with a preferred embodiment of the present invention.

With reference now to the figures, and in particular with reference to FIG. 1, a transformer in accordance with a preferred embodiment of the present invention is depicted. High voltage conductor 121 is connected to mounting point 122 of transformer 10 by external hardware connector 120. Mounting point 122 is the connection point of the back end 102 of conductor 114. Conductor 114 is covered by insulating material 104, which extends from second shoulder 106 of insulating mounting bracket 108 to the back end 102 of conductor 114. Insulating mounting bracket 108 is attached to transformer wall 116. Conductor 114 runs through insulating mounting bracket 108 so as to extend from the outside to the inside of transformer wall 116. Thus, conductor 114 is surrounded by insulating mounting bracket 108 at the point at which conductor 114 actually passes through transformer wall 116. As further provided in the illustrative embodiment, first shoulder 110 of insulating mounting bracket 108 and front end 112 of conductor 114 are immersed in oil 118 within transformer casing 100. Front end 112 of conductor 114 is utilized for connecting to transformer windings.

The invention provides an enhanced (i.e., higher rated) transformer utilizing an off-the-shelf transformer bushing and tubular insulating material. The bushing housing (i.e., insulating mounting bracket 108) is extended by the use of an insulating tube (or material) 104 that is electrically sealed to the bushing body (i.e., the second shoulder 106 of the insulating mounting bracket 108) and which covers a finite portion of conductor 114, which is otherwise exposed. The utilization of the insulating tube 104 (referred to hereafter as insulating material) enhances the creepage resistance and the strike resistance of the bushing. Also, the internal portion of conductor 114 is provided with an insulation barrier, which involves, in the preferred embodiment, submerging the internal conductor and first shoulder in oil 118 as illustrated in FIG. 1. In an alternate embodiment, insulating material, such as shrink tube may be utilized to cover the front end 112 of the conductor 114 to yield similar effects.

Figure 2A:
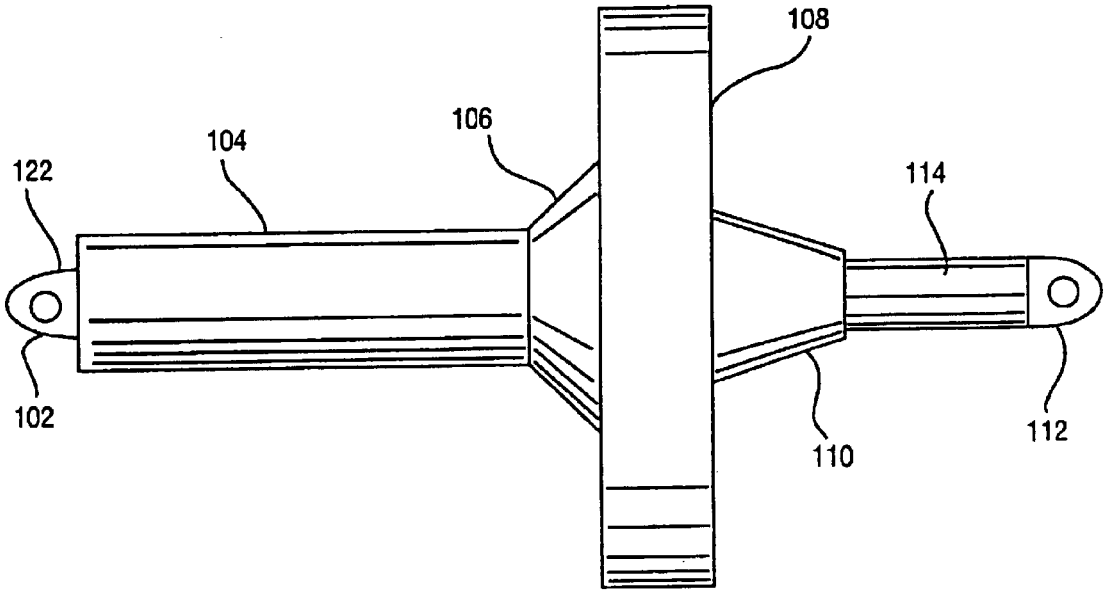
FIG. 2A illustrates a converted transformer bushing in accordance with a preferred embodiment of the present invention.

Referring now to FIG. 2A, there is illustrated an enhanced bushing according to the preferred embodiment. Insulating material 104, such as heat shrink tubing, is attached to the second shoulder 106 of the insulating mounting bracket 108. The insulating material 104 is applied to the second shoulder 106 of the insulating mounting bracket 108 so that the insulating material 104 covers (or extends over) a portion of the back end 102 of the conductor 114 and a portion of the second shoulder 106 of the insulating mounting bracket 108. In the preferred embodiment, insulating material is tubular to provide continuous coverage around and along the portion of the conductor 114 covered. This aids in reducing creepage and leakage along the insulating mounting bracket 108 as well as protecting against arcing from the conductor 114 to the transformer wall 116. In one embodiment, insulating material 104 is also applied to cover a portion of the external hardware connector 120 attached to back end 102 of conductor 114. This further increases strike distance and reduces creepage. However, by covering external hardware connector 120 with insulating material 104, the flexibility to change external hardware connector 120 is then limited due to the need to compromise the integrity of the insulator if the attaching hardware is removed or replaced.

The actual length of the insulating material 104 is dependent on the length of the conductor 114. However, it is not necessary that the insulating material extend to the back "end" 102 of the conductor 114, although the provided embodiments are illustrated and/or described in this manner. Thus, the insulating material may cover a portion of the conductor 114. The utilization of the insulating material 104, as provided by the invention, is based on the realization that the dielectric strength of the bushing wall greatly exceeds the dielectric strengths of either one of the creepage surfaces (external or internal) and the strike lengths. Therefore, the invention allows the substantial enhancement of the bushing rating by enhancing the interior and exterior portions of the bushing without further consideration required to address the bushing wall dielectric. Contrary to established Raychem literature, which states that the voltage class (i.e., rating) of transformer bushings cannot be enhanced by the use of the heat shrinking tubing utilized by the invention, the invention provides substantial enhancements in overall transformer ratings.

Figure 2B:
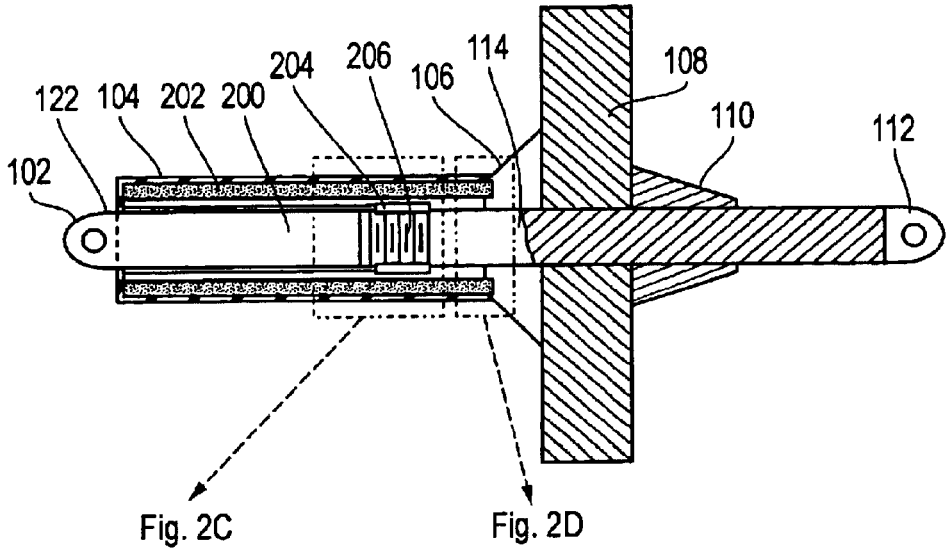
FIG. 2B illustrates a cross section of the converted transformer bushing of FIG. 2A in accordance with a preferred embodiment of the present invention.
Figure 2C:
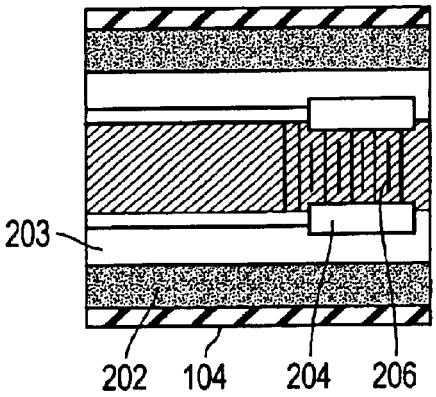
FIG. 2C illustrates a detailed cross section of an extension attached to a bushing in accordance with a preferred embodiment of the present invention.
Figure 2D:
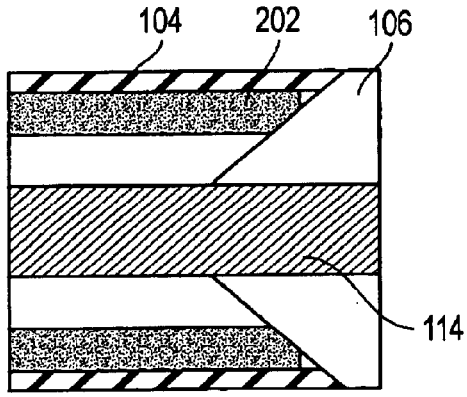
FIG. 2D illustrates a detailed cross section of mastic and insulating material applied to a second shoulder of an insulating mounting bracket in accordance with a preferred embodiment of the present invention.

Referring now to FIGS. 2B–2D, various illustrations of a detailed cross section of a converted or enhanced transformer bushing in accordance with a preferred embodiment of the present invention are illustrated. As illustrated, insulating material 104 connects only to second shoulder 106 of insulating mounting bracket 108 and extends over conductor 114 so as to leave a space 203 between conductor 114 and insulating material 104. In the illustrative embodiments, prior to attaching insulating material 104, a mastic 202 is applied. The mastic 202 is applied to the second shoulder 106 of insulating mounting bracket 108. Mastic 202 is applied to this area because the insulating material 104 will cover a portion of the second shoulder 106 of the insulating mounting bracket 108 as well as the conductor 114. The mastic 202 is one method of electrically sealing the insulating material 104 to the bushing housing. However, the invention recognizes that shrink tubing is commercially available with a treated interior surface that seals when heated. Thus, utilization of the mastic 202 is not a requirement for the correct operation of the invention, and other alternate sealing methods may be utilized.

In the preferred embodiment, the mastic is placed only between the shrink tubing and the second shoulder 106 of the insulating mounting bracket 108. However, in an alternate embodiment and as illustrated, the mastic is applied to other areas including the conductor. Thus, as illustrated, the mastic 202 is also applied to cover up to back end 102 of conductor 114 (i.e., up to a mounting point 122 for external hardware). When, as described below, an extension 200 is connected, the mastic is also applied to the extension 200 and the threaded portion (bushing stud) 206 of the conductor 114 along with jam nut 204 so as to completely cover all conductive material from the second shoulder 106 of the insulating mounting bracket 108 to the back end 102 of the extension to the conductor 114. Of course, mastic 202 is only applied to the portion of the conductor 114 (and extension) that is to be covered by insulating material 104.

The utilization of a mastic 202 is not always required for the proper operation of the invention because the insulating material 104 by itself is able to reduce creepage as well as protect against arcing from conductor 114 to the transformer wall 116. However, proper application of the mastic 202 to a portion of the second shoulder 106 of the insulating mounting bracket 108 is important to ensure there are no voids between the insulating material 104 and the second shoulder 106 of the insulating mounting bracket 108. This further prevents creepage from the second shoulder 106 of the insulating mounting bracket 108 to the transformer wall 116.

In bushing designs with a longer exposed or non-insulated conductor 114, it is possible to insulate portions of the exposed conductor 114 to provide the increased distance from the exposed segment of the conductor 114 to the transformer wall 116. In one embodiment in which the conductor length is shorter than desired, an extension is attached to the conductor 114 as illustrated in FIGS. 2B and 2C. The conductive extension 200 is necessary when the required voltage enhancement tube (insulating material 104) exceeds or almost exceeds the length of conductor 114. The conductive extension is also necessary when a spade or eyebolt connector is required for external wiring.

Figure 4A:
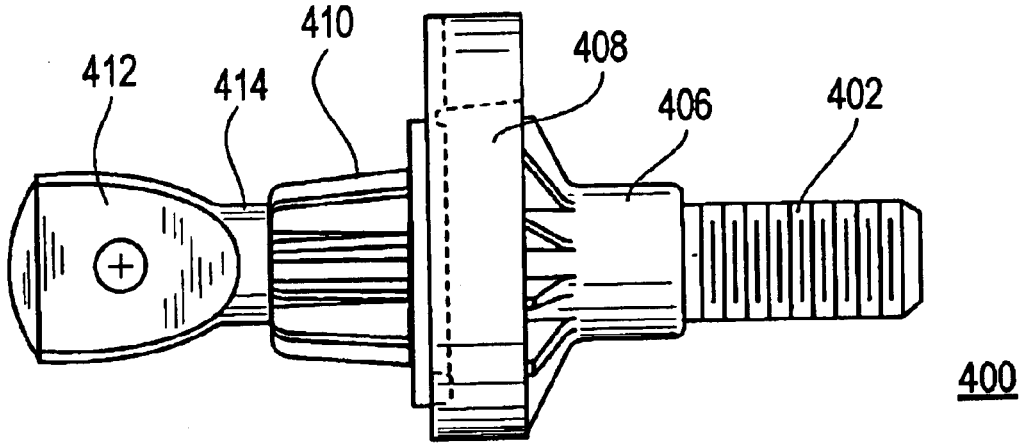
FIG. 4A (Prior Art)
FIG. 4A is a molded bushing that is commonly used in the manufacture of oil-filled transformers.
Figure 4B:
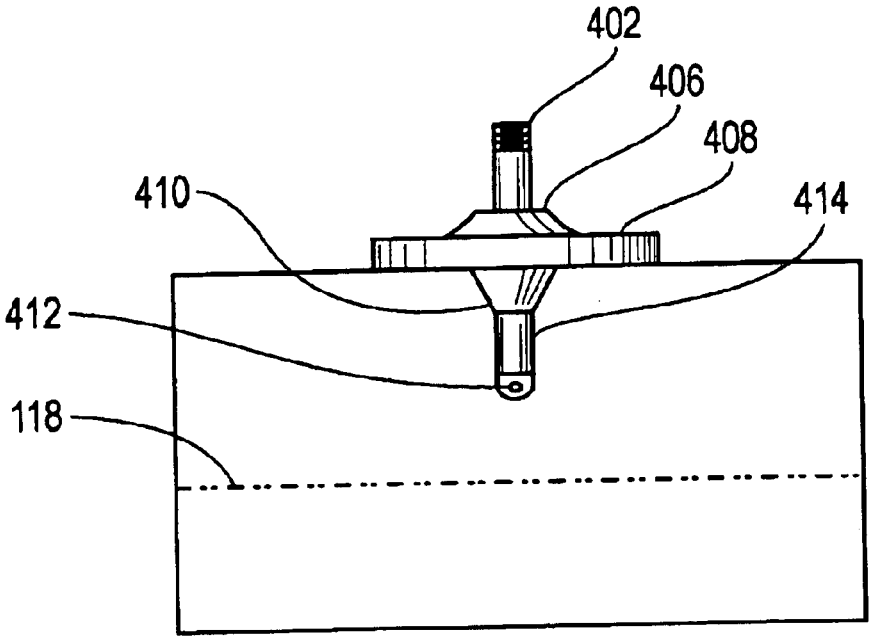
FIG. 4B (Prior Art)
FIG. 4B is a molded bushing installed in a transformer as is commonly used in the art.

In the exemplary embodiment, by way of illustration and not of limitation, an off-the-shelf molded transformer bushing similar to the one shown in FIG. 4A is depicted with a conductor 114 that comprises a bushing stud 206 with a threaded portion at back end of conductor 114. FIG. 4B illustrates the off-the-shelf transformer bushing connected to the transformer casing with the threaded portion of the back end of the conductor 114 extending out from the casing. A conductive extension 200 is attached via the bushing stud 206. In the preferred embodiment, the bushing stud 206 comprises male threading as shown in FIGS. 2B–2D and the conductive extension 200 comprises female threading to match the bushing stud's male thread. A jam nut 204 is utilized to lock the conductive extension 200 to the bushing stud. Anyone skilled in the art will recognize that there are other ways to attach an extension. Conductive extension 200 increases the distance between the back end 102 of the extended conductor and transformer wall 116.

Any length of conductive extension 200 and associated insulating material 104 cover can be utilized to increase the standard bushing rating by a measurable amount, so long as the distance from a non-insulated portion of the conductor 114 (or conductive extension 200) to transformer wall 116 is increased. The increase in distance means more air must ionize before the potential difference between the transformer wall 116 and the conductor 114 (or conductive extension 200) becomes sufficiently large enough to create a path through which current can flow. Therefore, the longer an extension, the greater the strike distance. In addition, external creepage is substantially minimized because the current has a significantly further distance to travel.

In one preferred embodiment, an analysis of the effects of the length of the conductive extension 200 and the length of the insulating material 104 to the transformer rating is completed and a chart is prepared that indicates the correlation between length and rating. FIG. 5 illustrates a sample rating chart that may be provided. It is understood that the chart is provided solely for illustrative purposes, and different rating charts may be compiled and utilized within the scone of the invention. By choosing the proper hardware and length of heat shrink tubing, external creepage can be substantially eliminated and the strike distance of the bushing assembly can be increased to the point at which arcing effects are negligible.

As shown, the bushing has an external portion located outside the transformer and an internal portion located inside the transformer. Once the rating on the external portion of the bushing is increased by the methods described above, the internal surface of the bushing becomes the lowest rated portion of the bushing. In the preferred embodiment, the rating on the internal surface of the bushing is increased by mounting the bushing with the internal surface submerged under oil 118. By immersing front end of conductor 112 and first shoulder 110 of insulating mounting bracket 108 in oil 118, the rating of the internal surface of the bushing can be significantly increased and thereby, the voltage class of the transformer is also increased. As provided above, utilization of an insulating tube to cover front end 112 of conductor 114 and first shoulder 110 of insulating mounting bracket 108 may also provide the increased rating of the internal surface of the bushing and hence the voltage class of the transformer.

Figure 3:
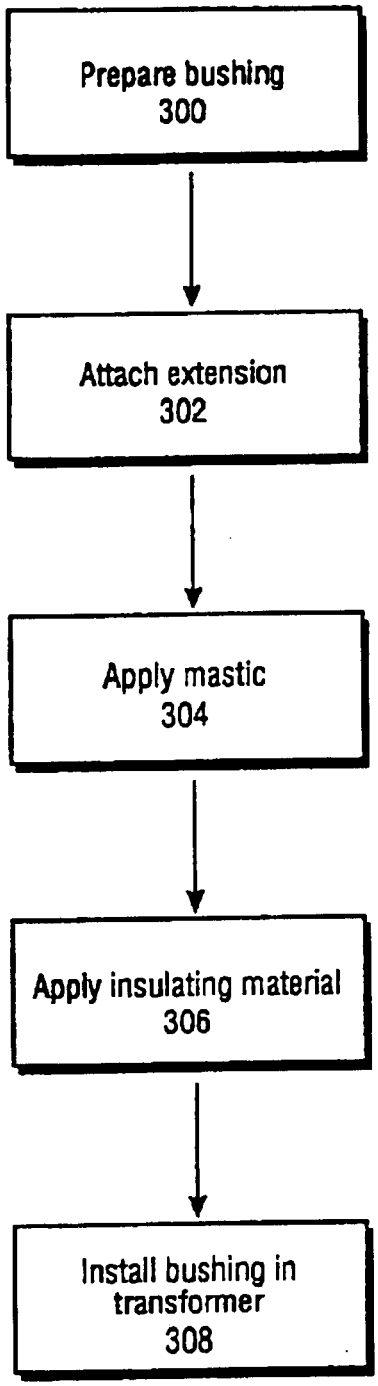
FIG. 3 is a high-level block diagram exemplifying a method for improving a transformer rating in accordance with a preferred embodiment of the present invention.

Referring now to FIG. 3, a high-level block diagram exemplifying a method for improving a transformer rating in accordance with a preferred embodiment of the present invention is illustrated. In order to further clarify this method, reference to FIGS. 1, 2A–2D and 4A is encouraged and will be referred to throughout the following process steps. The process begins with step 300, which depicts preparing a plastic bushing to receive a threaded conductive extension 200 and mastic 202. The bushing may be similar to a 1.2 kV Tuf Ex-Mount™ illustrated in FIG. 4A. The process next passes to step 302, which illustrates extension 200 being attached to the threaded portion of bushing stud 206 of the Tuf Ex-Mount™ plastic bushing similar to the one shown in FIG. 4A. Anyone skilled in the art will recognize that there are other ways to attach an extension.

The process then proceeds to step 304 which depicts applying mastic 202. The mastic 202 is applied to help the heat shrink insulating material 104 adhere to the insulated mounting bracket 108. The mastic 202 is also applied to conductor 114 and extension 200 so as to completely cover back end 102 of conductor 114 as shown in FIG. 2A from the second shoulder 106 of the insulating mounting bracket 108 to the back end 102 of the conductor 114. Proper application of the mastic 202 to conductor 114 and a portion of the second shoulder 106 of the insulating mounting bracket 108 is important to ensure there are no voids between the insulating material 104 and the second shoulder 106 of the insulating mounting bracket 108. This prevents creepage from the second shoulder 106 of the insulating mounting bracket 108 to the transformer wall 116.

Returning to FIG. 3, the process then proceeds to step 306 which illustrates applying heat shrink tubing or insulating material 104 to the conductor 114 and other connecting surfaces. An insulating material 104, such as Raysulate BPTM and BBIT high-voltage insulating tubing, a product of Raychem, Menlo Park, Calif., is installed from the second shoulder 106 of the insulating mounting bracket 108, to the back end 102 of the conductor 114. The heat shrink tubing, which has a high voltage insulating property is installed over the complete area covered by the mastic 202. If the heat shrink tubing is factory installed, a wide variety of hot air ovens or infrared heaters can be used to shrink the tubing. If the heat shrink tubing is installed on a transformer bushing in the field, a clean-burning propane torch with a "bushy" flame can be used to shrink the tubing. In the preferred embodiment, the heat is applied until the heat shrink tubing shrinks onto and tightly conforms to the second shoulder 106 of insulating mounting bracket 108. In another embodiment, the heat is evenly applied until the heat shrink tubing shrinks onto and tightly conforms to conductor 114, insulating mounting bracket 108, and any other surface being insulated. Insulating material 104 and mastic 202 can also be applied to cover a portion of the external hardware 120 attached to back end 102 of conductor 114. This further increases strike distance and reduce creepage.

The process then continues to step 308 which depicts completing the installation of the bushing. When installed, the bushing has an external portion located outside the transformer and an internal portion located inside the transformer. By immersing front end conductor 112 and first shoulder 110 of insulating mounting bracket 108 in oil 118, the rating of the internal surface of the bushing can be significantly increased and thereby, the voltage class of a transformer is also increased.

While the invention has been particularly shown and described with reference to a preferred embodiment, it will be understood by those skilled in the art that various changes in form and detail may be made therein without departing from the spirit and scope of the invention.

What is claimed is:

1. An apparatus that provides improved transformer voltage rating, comprising:

a transformer bushing for use within a transformer, said busing having:

an insulating mounting bracket with a first and second shoulder; and a conductor which extends through and is molded into said insulating mounting bracket with a first portion for connecting to transformer windings and a second portion for connecting to an external circuit;

means for enclosing a portion of said conductor and said second shoulder of said insulating mounting bracket with insulating material, wherein a distance between an un-insulated portion of said second portion of said conductor and a wall of the casino of said transformer is greater than without said insulating material; and means for extending said second portion of said conductor to provide an extended second portion having a conductor extension attached to said second portion, wherein said means for enclosing encloses both said second portion of said conductor and a portion of said conductor extension.

2. The apparatus of claim 1, wherein said conductor is a metallic, molded-in conductor.

3. A bushing assembly kit for improving a transformer voltage rating comprising:

a transformer bushing for use within a transformer, said bushing having:

an insulating mounting bracket with a first and second shoulder; and a conductor which extends through and is molded into said insulating mounting bracket with a front portion at said first shoulder for connecting to transformer windings and a back portion at said second shoulder for connecting to an external circuit, said back portion having a back end;

insulating material for enclosing a portion of said back portion of said conductor and said second shoulder of said insulating mounting bracket, wherein a distance between an un-insulated portion of said second portion of said conductor and a wall of said transformer is greater than without said insulating material;

a conductor extension made of conductive material for connecting to the back end of said conductor, and means for connecting said conductor extension to said back end of said conductor, wherein a total length of a resulting extended back end of said conductor is increased by the length of said conductor extension.

4. The kit of claim 3, further comprising a supply of mastic for applying to said second shoulder prior to attaching said insulating material.

5. The kit of claim 4, further comprising a rating chart, which indicates a length of said insulating material and a length of said conductor extension, if required, to connect to said second portion of said conductor of said bushing in order to obtain a corresponding rating of a transformer in which said bushing is utilized.

* * * * *

UNITED STATES PATENT AND TRADEMARK OFFICE

CERTIFICATE OF CORRECTION

PATENT NO. : 6,787,704 B2
APPLICATION NO. : 09/850657
DATED : September 7, 2004
INVENTOR(S) : Donald W. Owen It is certified that error appears in the above-identified patent and that said Letters Patent is hereby corrected as shown below:

In Claim 1, at column 8, line 7, delete "casino of" and insert --casing of--.

Signed and Sealed this

Twentieth Day of March, 2007

JON W. DUDAS
*Director of the United States Patent and Trademark Office*